US007504781B2

(12) United States Patent
Wendt et al.

(10) Patent No.: US 7,504,781 B2
(45) Date of Patent: Mar. 17, 2009

(54) METHOD FOR DRIVING A LED BASED LIGHTING DEVICE

(75) Inventors: Matthias Wendt, Wuerselen (DE); Christoph Martiny, Aachen (DE)

(73) Assignee: Koninklijke Philips, N.V., Eindhoven (NL)

( * ) Notice: Subject to any disclaimer, the term of this patent is extended or adjusted under 35 U.S.C. 154(b) by 7 days.

(21) Appl. No.: 11/577,366

(22) PCT Filed: Oct. 17, 2005

(86) PCT No.: PCT/IB2005/053401

§ 371 (c)(1),
(2), (4) Date: Apr. 17, 2007

(87) PCT Pub. No.: WO2006/043232

PCT Pub. Date: Apr. 27, 2006

(65) Prior Publication Data

US 2008/0084169 A1 Apr. 10, 2008

(30) Foreign Application Priority Data

Oct. 22, 2004 (EP) ..... 04105235

(51) Int. Cl.
*H05B 37/00* (2006.01)

(52) U.S. Cl. ..... 315/291; 315/307; 315/308

(58) Field of Classification Search ..... 315/307, 315/308, 291; 362/800
See application file for complete search history.

(56) References Cited

U.S. PATENT DOCUMENTS

| | | | | |
|---|---|---|---|---|
| 5,013,971 | A | 5/1991 | De La Chapelle | |
| 5,783,909 | A | 7/1998 | Hochstein | |
| 6,285,139 | B1 | 9/2001 | Ghanem | |
| 6,359,918 | B1 | 3/2002 | Bielas | |
| 6,466,188 | B1 | 10/2002 | Cato | |
| 6,693,394 | B1 | 2/2004 | Guo et al. | |
| 2003/0117087 | A1 | 6/2003 | Barth et al. | |
| 2004/0041526 | A1 | 3/2004 | Vollrath | |
| 2007/0133199 | A1 * | 6/2007 | Lebens et al. | 362/157 |

FOREIGN PATENT DOCUMENTS

EP 1113708 A2 7/2001

* cited by examiner

*Primary Examiner*—David Hung Vu

(57) ABSTRACT

A lighting device, and a lighting system including such a lighting device and an adjustable power source, includes at least one LED, a control device employing a device for measuring a quantity that is indicative of an electrical resistance of the LED at a predetermined current or voltage, a power supply control device for controlling an adjustable electrical power supply for driving the LED. The electrical resistance of a LED is functionally dependent of the LED's junction temperature, which in turn determines its optical output characteristics. Thus, by measuring the junction temperature indirectly, through measuring of electrical LED characteristics, and mapping them to a temperature, LED output control is possible.

20 Claims, 2 Drawing Sheets

METHOD FOR DRIVING A LED BASED LIGHTING DEVICE

Figure 1:
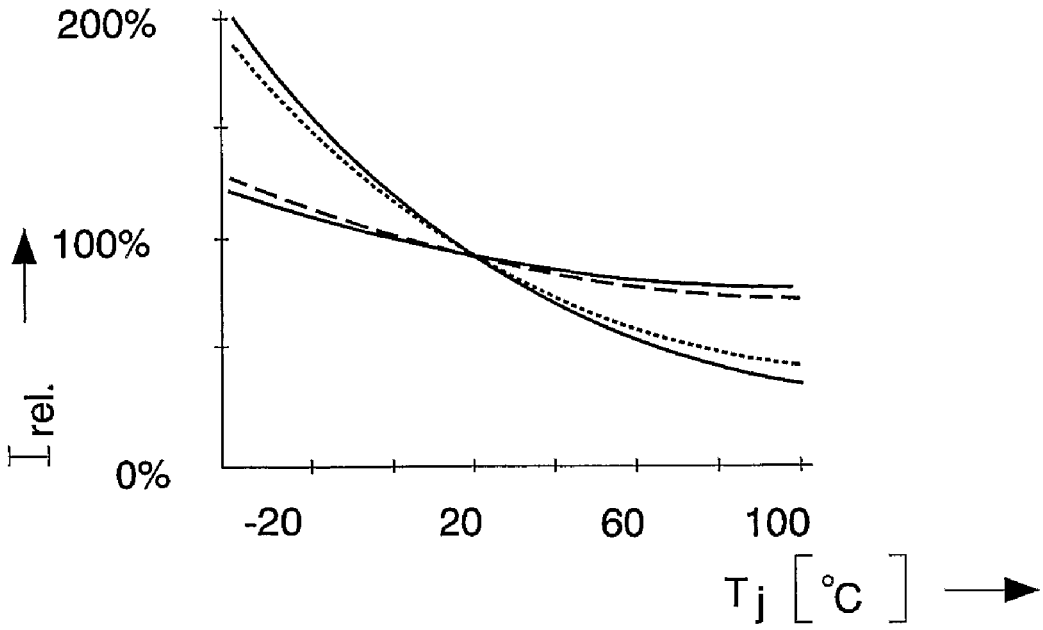

The present invention relates to lighting systems with one or more LEDs, in which the LEDs are controlled to compensate for temperature changes.

In particular, in a first aspect of the invention, the invention relates to a lighting device, comprising at least one light emitting diode (LED), a control device that comprises a measuring means constructed to determine a value of a quantity that is correlated to operation of said LED, a power supply control means connected to said measuring means and constructed to provide a control signal to an adjustable electrical power supply for driving the LED, said signal being based on said value of said quantity as determined by said measuring means.

Light emitting diodes, or LEDs, are in increasingly widespread use as a source of light, due to their high efficacy and long life. A well-known problem with LEDs is, however, that the intensity of the emitted light is strongly dependent of the temperature. In general, at a higher temperature the intensity is lower.

This problem has been tackled in the prior art. E.g., document U.S. Pat. No. 5,783,909 describes a circuit for maintaining the luminous intensity of an LED. The circuit comprises a sensor for sensing changes in the luminous output or the operating temperature of the LED, which sensor is coupled to a power supply. A predetermined temperature behavior model may be pre-programmed into a chip for the power supply.

A problem of this circuit is that it does not offer optimum control over the light as output by the LED.

An object of the present invention is to provide a lighting device of the kind mentioned above, that allows an improved control over the light output of the LEDs.

The invention is thereto characterized in that said quantity is a quantity that is indicative of an electrical resistance of said LED.

The inventors have realized that it is control and/or knowledge of the temperature of the active region, i.e. the junction region, of an LED which determines the accuracy of control of the luminous output. For, when measuring luminous output instead, it is rather difficult to shield ambient light, or light from other LEDs, and when measuring temperature, it is always the temperature of either the working environment of the LED, or at most the temperature of the full LED which is measured. However, the optical properties are determined by the LED's junction, which may have a different temperature, due to a non-homogeneous temperature of the LED.

Furthermore, the inventors realized that it is not necessary to measure junction temperature directly, but that this is possible by measuring a directly correlated quantity, in particular relating to the thermodynamics of charge carriers at the junction. For example the V,I-characteristic of a pn-diode is characterized by:

$$I = I_S \cdot \exp\left(-\frac{V - R_s \cdot I}{k_B \cdot T}\right),$$

where I is the current, $I_S$ is the saturation current, V denotes the voltage, $R_S$ is the series resistance, T is the temperature and T is the temperature. For a LED with a more complex structure than a simple pn-diode the relation for the V,I-characteristic will be more involved to, but for any particular LED, it is a function that is known or at least can be determined and calibrated for.

For example, one measures the voltage of the LED at a given current and compares it to the temperature dependent calibration measurement of (V,I) as a function of $T_{junction}$ to conclude on the junction temperature. Such V,I characteristic may also be called the "resistance" of the junction, although it should be kept in mind that an LED is a non-linear device, and the resistance, i.e. V/I, is itself a function of current I. Measuring said resistance, or a quantity directly related thereto and indicative thereof, gives direct knowledge of the temperature of the junction, either through previous calibration measurements or other means of evaluating the junction temperature on the basis of the measured value.

Similarly, providing the evaluated junction temperature to the adjustable power supply offers the possibility of control over the LED's junction, and thus over the luminous output. Again, this may be achieved through previous calibration measurements or other means.

Note that it is similarly possible to obtain direct knowledge of the junction's temperature with this device, through mapping of the measured value of the quantity to a function that relates said quantity to said junction temperature. The junction temperature thus found may be used in any desired application.

In a special embodiment, said quantity comprises an electrical current through said LED at a predetermined measuring voltage across said LED, and/or a voltage across said LED at a predetermined measuring current through said LED. In either way, two values are obtained for the voltage across, and the current through the LED, respectively. By dividing the former by the latter, the value of the resistance of the LED may be obtained, although simply measuring the current or voltage at a predetermined measurement voltage or current, respectively, suffices. Note that it is also possible to obtain the relevant values indirectly, e.g. the current through the LED may be determined by determining a voltage across a resistor of a known value, and dividing said voltage by said resistance value, etc. For the purpose of this invention, any such measures, that provide direct or indirect knowledge of the resistance of the LED are deemed equivalent.

In a particular embodiment, said measuring means comprises a measurement voltage source for providing said predetermined measurement voltage, and/or a measurement current source for providing said predetermined measuring current. This encompasses e.g. the situation that one or more separate voltage and/or current sources are provided. Another possibility is the situation that an external and optional electrical power supply, that is connected for driving the LED, may be controllable by the device of the invention, et cetera.

In a particular embodiment, said predetermined measurement voltage is smaller than a forward driving voltage of said LED, or said predetermined measurement current is smaller than a forward driving current of said LED. Herein, forward relates to a direction of the current being in a direction of conductivity of the LED, so not the so-called reverse direction. Here is meant a voltage in forward direction, that causes a current through the LED which is less than half of the lowest driving current as provided to the LED by the power supply in active mode, or similarly a current in forward direction, that causes a voltage across the LED (or junction) that is less than a diode voltage drop in active mode. An advantage of measuring resistance or related quantities such as voltage or current in these circumstances is that the self heating of the junction is reduced. Thus the calibration accuracy can be high without the need for high speed measurement circuitry. In addition the reduced LED current gives less light and reduces light artefacts during measurements for the phases in which the LED is supposed to be dark. Another advantage of measuring resistance or related quantities such as voltage or current in small-signal circumstances is that the resistance of the LED's junction, and thus of the LED, is much higher than in active mode. Active mode relates to any practical light emitting situation, since in the small-signal situation as discussed here, the LED emits hardly any optical energy."

In a special embodiment, the control device comprises a switch for selectibly connecting said LED to said measuring means. This relates to the device having a switch with two positions. In one position, the LED is connected to the measuring means, and e.g. to a separate measurement voltage source or measurement current source, while in a second position, the LED is connected or connectable to an electrical power supply for driving the LED in active mode. This measure provides the advantage that a separate measurement voltage or current source may be supplied, which is designed for better performance when measuring, while the electrical power supply for driving the LED in active mode may be designed for better performance when driving the LED in active mode, for lower cost or any other reason. For example, the measuring voltage source may be a simple supply that is non-adjustable but highly precise, while the (larger) electrical power supply is adjustable, and e.g. less precise. The switch allows switching between the two power sources.

In an advantageous embodiment, the control device comprises an information retrieval means, that contains information on the control signal as a function of the measured value of said quantity, and in particular, the information retrieval means comprises a look-up table. The information contained in the information retrieval means is thus available for controlling the adjustable power supply, such that the lighting device may work autonomously. Alternatively, the measurement signal may be used by e.g. an external operator for adjusting an electrical power supply that is connectable to the LED or LEDs. The information retrieval means may be embodied as a look-up table, or alternatively as any circuitry, computer device, etc. with similar functionality, such that an input value of the measured quantity is returned as another value or a signal for controlling an electrical power supply for driving the LED.

In a special form, the lighting device comprises at least two LEDs, wherein said value of said quantity is selectibly measurable by said control device, in particular by said measuring device, for each of the at least two LEDs. In particular, each of the at least two LEDs is individually drivable by an adjustable electrical power supply on the basis of said measured value of said quantity for said LED. These measures allow separate control over at least two, and advantageously over all LEDs. This offers in turn the possibility of very homogeneous lighting, in that at least two LEDs, and advantageously every LED, may be individually adjusted.

Furthermore, knowledge of the junction temperature of the LEDs allows specific correction of color or color temperature, since the behavior of every type of LED is known or may be known after calibration. When e.g. a different illumination level has to be set, the effect of increased input power will effect the LED temperature and thereby the contribution of the different color LEDs to the total illumination. This can be corrected for individually by monitoring the junction temperature of each LED device or each number of LEDs of a given color. The invention allows for the correction of the temperature effect at a given current level that can be used in a pulsed driving mode like PWM for example.

In a second aspect of the invention, there is provided a lighting system comprising a lighting device according to the invention, and an adjustable electrical power supply connected to a LED of said lighting device, for supplying electrical energy to drive said LED. This relates to the case wherein the lighting device according to the invention is already connected to its own power supply for driving the one or more LEDs, and may thus serve as a stand-alone system. E.g., the adjustable electrical power supply may comprise a battery or other supply with circuitry for setting a desired driving voltage or driving current for the LED or LEDs. The adjustable power supply may be exchangeable, either completely or partly, e.g. leaving the above mentioned circuitry in its place.

In a special embodiment of the lighting system, the adjustable electrical power supply is further able to provide a predetermined measuring voltage across said LED, and/or a predetermined measuring current through said LED, wherein said predetermined measurement voltage is smaller than a forward driving voltage of said LED, or said predetermined measurement current is smaller than a forward driving current of said LED. Thereto, the adjustable electrical power supply may comprise e.g. a switch to switch between a position in which the power supply supplies the predetermined measuring voltage or measuring current, and a position in which the power supply supplies the driving current and or driving voltage to the LED(s), or the adjustable power supply comprises a separate supply to such end, etc.

In a third aspect, the invention relates to a method of driving a lighting system according to the invention, the method comprising setting said adjustable electrical power supply to a desired operating condition for at least said LED, measuring a value of a quantity that is indicative of an electrical resistance of said LED, determining a new operating condition of said LED, based on said measured value, and adjusting said adjustable electrical power supply to said new operating condition. This is a general method of operating the inventive lighting system. In principle, this method may be used by an operator, to set the driving current and/or voltage for a LED on the basis of a measured value of the LED's resistance. However, advantageously, the method is automated in a lighting system according to the invention.

In a special embodiment of the method, measuring said value comprises measuring of an electrical current through said LED at a predetermined measuring voltage across said LED, and/or measuring of a voltage across said LED at a predetermined measuring current through said LED. By offering the possibility of measuring at a predetermined measuring voltage or measuring current, which may differ from the (variable) driving voltage and/or driving current of the LED, a higher precision may be obtained, since said predetermined measuring current and/or voltage may be selected such that a desired accuracy may be obtained, independent of the driving current or voltage.

In particular, said predetermined measuring voltage is smaller than a voltage across said LED in an operating condition of said LED, and/or said predetermined measuring current is smaller than a current through said LED in an operating condition of said LED. For reasons as explained above, selecting a small measuring voltage and/or measuring current allows generally a higher precision, since under those conditions, the resistance of the LED is higher and may be determined more precisely.

Figure 2:
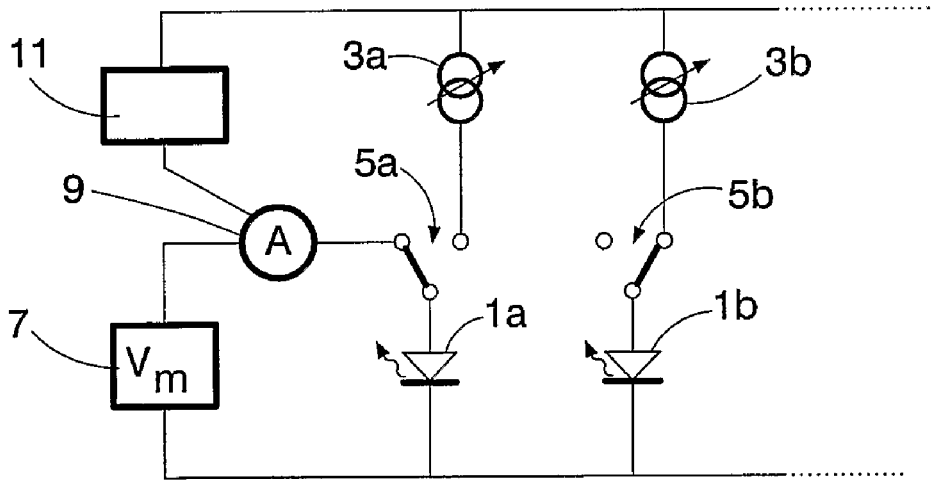
Figure 3:
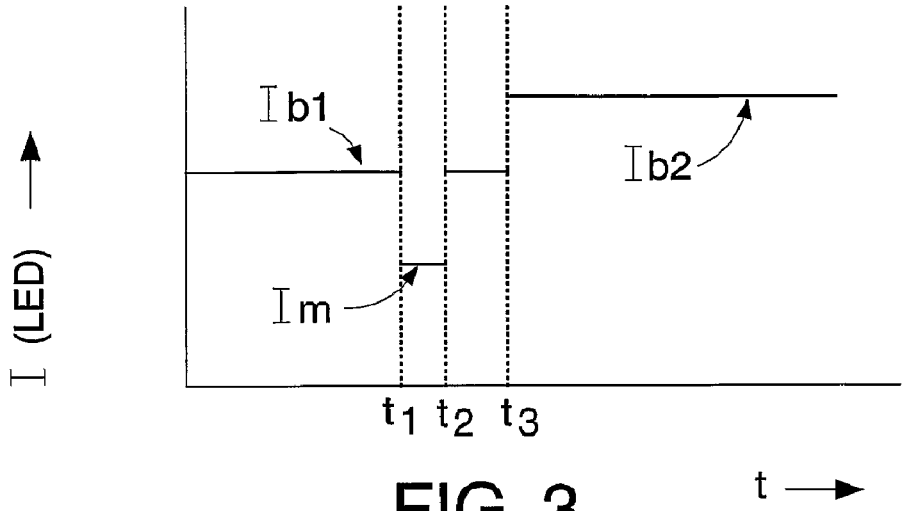
Figure 4:
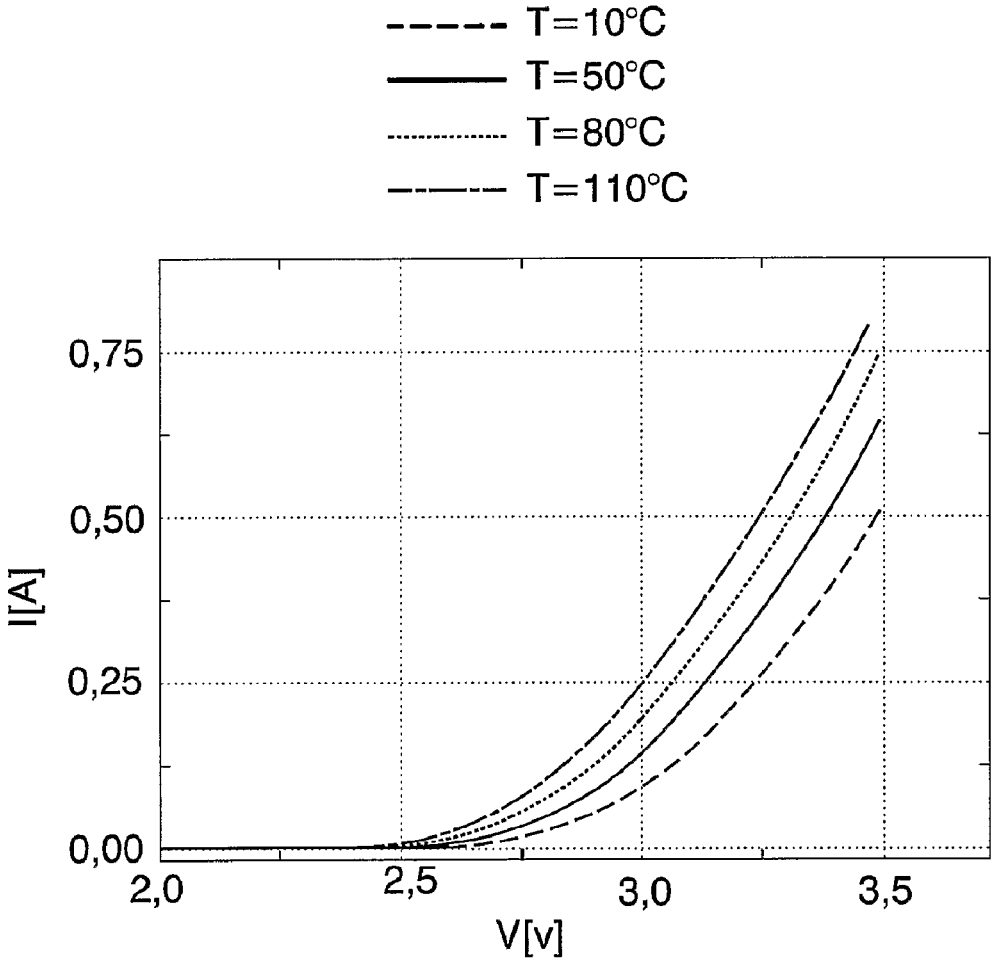

The invention will now be elucidated further, with referral to the drawings, in which non-limiting embodiments of the invention are depicted, and in which:

FIG. 1 schematically illustrates the dependence of light output on junction temperature for a number of LED types;

FIG. 2 schematically shows an embodiment of a lighting system according to the invention;

FIG. 3 schematically shows a time sequence for measuring and driving an LED, according to a method of the invention; and FIG. 4 schematically shows I,V characteristics for a LED at different junction temperatures.

In FIG. 1, the diagram schematically shows the relative light output $I_{rel.}$, in arbitrary units, as a function of junction temperature, for four different color LEDs, in this case blue (solid line), green (dashed line), red (dotted line) and amber (dot-and-dash line). It is clearly visible that even a small temperature variation causes a large shift in optical output, which has to be compensated e.g. by adjusting the power to the LED. Note further that the temperature dependence differs for LEDs of different colors. This means that, when different LEDs are used to mix colors, a color shift will occur when the junction temperature shifts. For the example shown, an increase of junction temperature lowers the amber and red contribution much more than the blue and green contribution, thus causing a shift to "cooler" colors.

By means of the invention, knowledge about the junction temperature may be obtained, through measurement of junction resistance or a related quantity. This allows individual correction of the LEDs, and thus correction of color shift.

FIG. 2 schematically shows an embodiment of a lighting system according to the invention. Herein, 1*a*, 1*b*, . . . , are light emitting diodes or LEDs, while adjustable current sources are denoted 3*a*, 3*b*, . . . . Switching devices 5*a*, 5*b*, . . . , can switch the electrical connection of an LED to a measurement voltage source 7 and current meter 9, which is coupled to a control unit 11, which in turn is coupled to the adjustable current sources 3*a*, 3*b*, . . . . Note that this measurement is done for one LED at a time. Advantageously, one LED is measured while all other LEDs, if any are present, are switched off or are at least electrically decoupled from said LED. Multiple measuring circuits are possible, each decoupled from the other LEDs.

As an alternative, instead of a measurement current source, a measurement voltage source, that provides a predetermined voltage across the LED, may be used. Herein, a current through the LED is measured by a current meter, instead of the voltage meter.

A third embodiment, not shown here, comprises a driving current source that can be set to a measurement current for the measurement phase and with a switch that allows for monitoring the voltage across the LED.

In FIG. 2, there are shown two LEDs 1*a* and 1*b*. It should be noted that any number of LEDs is possible, such as only one LED, but also three or more, for example for mixing colors. In the latter case, it is possible to use for example red, green and blue LEDs, each color receiving its own power, or even each LED receiving its individual electrical power.

In all systems also a series connection of LEDs is possible, especially if the LEDs are of the same kind. The voltage could be measured across one LED exemplarily or also over all LEDs in series, thereby averaging the temperatures of the multiple devices. Individual measurements provide better accuracy, but are more complex.

LED 1*b* receives electrical power from a current source 3*b*, since switching device 5*b* connects the two parts. Current source 3*b* is adjustable, in order to be able to adjust the optical output of the corresponding LED 1*b*. Current sources 3*a*, 3*b*, . . . , are shown as separate sources, although it is likewise possible to provide one current source which is able to power all desired LEDs with a desired current, e.g. through a voltage divider. Note that it would also be possible to supply electrical power to the LEDs by means of an adjustable voltage source.

Contrarily, with the switching device 5*a* as shown here, the LED 1*a* receives a measuring voltage from measuring voltage source 7. This source 7 supplies a measuring voltage Vm to the LED 1*a*, which causes a measuring current Im to flow through the LED, which current is dependent on Vm and/or the temperature of the junction of the LED. Once Im is given only one of the parameters Vm or T represents a further independent variable. The current is measured with a current meter 9. On the basis of the voltage Vm, which is known, and the measured current, the resistance of the LED, and in particular the junction temperature thereof, may be derived.

The value of the current, or of the resistance, which is in principle corresponding information, is supplied to a control unit 11, depicted only schematically. The control unit may contain information on the dependence on temperature of either the resistance of the LED, or junction, or directly related a quantity such as current through the LED or voltage across the LED. Thereto, the control unit may e.g. comprise a look-up table, or similar circuitry, or may comprise or be connected to a computer or other digital or analogue device that is able to store and provide the relevant data. When the control unit 11 receives a value of a measured current, resistance or voltage, as the case may be, the control unit is able to provide a control unit that will set the correct current, or corresponding voltage, for the relevant LED or LEDs. In this case, measuring of LED 1*a* will result in the control unit 11 setting current source 3*a*. Of course, control unit 11 will also be able to control the switching devices 5*a*, 5*b*, etc. in order to selectibly measure a desired LED.

A method of measuring and controlling the LEDs will be elucidated in connection with FIG. 3, which schematically shows a time sequence for measuring and driving an LED, according to a method of the invention.

In the diagram, the current I(LED) through the LED is plotted as a function of time t. Initially, i.e. at t<t1, the I(LED) is equal to $I_{b1}$, a normal driving current at which the LED gives a desirable output. This current $I_{b1}$ is a current which is often, but not necessarily, larger than the "knee current", or current at the knee voltage of the LED. The knee voltage is, in a linear scale I-V plot, the voltage of the "bend" of the curve, and a kind of lower limit of the forward voltage drop over the LED in any practically useful situation.

At t=t1, the switching device relating to the relevant electrode switches to a measuring position, in which the measuring voltage sources applies a measuring voltage to the LED, resulting in a new current Im to flow through the LED. This current Im is measured. The measurement takes place between time t1 and t2, in order to obtain a reliable value. On the basis of the measured value of Im, and the known value of the measuring voltage, a new value for the current I(LED) is determined by the control unit to be $I_{b2}$. This may be brought about e.g. by mapping the current value Im to a junction temperature and subsequently to a value for I(Led) that gives the desired new optical output, by mapping the Im directly to a desired I(LED), etc. As soon as the desired value for $I_{b2}$ has been determined, it is set by the control unit, at a time t3.

Note that in the case shown, the new I(LED) is set only some time after determination of the measuring current Im. During the time between t2 and t3, it is e.g. possible to have zero current through the LED, to maintain the measuring current Im until such time that the new I(LED)=$I_{b2}$ may be set, or, preferably, to supply again the original I(LED), i.e. $I_{b1}$, until the time t3 when $I_{b2}$ may be set. The latter measure ensures that the LED may provide output during said time, even when not necessarily the optimum output. Of course, the switching device reconnects the LED to the adjustable current source at a corresponding point in time, such as immediately after determining Im, or only at the time of setting the new $I(LED)=I_{b2}$.

It can be seen in FIG. 3 that the measuring current Im is preferably smaller than the normal driving currents $I_{b1}$ and $I_{b2}$ and the like. Although this is not necessary, a smaller measuring current means that the diode has a higher resistance, which can be measured more precisely.

It is remarked here that the LED control method and system according to the invention require that normal driving of the LED is interrupted. However, in practice a LED is seldom driven continuously, but rather intermittently. It is convenient to measure the LED and calculate a new current in such times of inactivity. However, even in cases in which the LED is driven for a time period that is longer than the desired interval for checking the LED, it is no problem to interrupt operating the LED for a short time, in order to measure the LED and if necessary adjust the I(LED). Most applications do not need a continuous operation of the LED, and interrupting operation of the LED has hardly if any influence on the life span of the LED.

An alternative way of controlling the LED's output, in case the LED is driven by a pulsed current source, would be to change the pulse width and/or frequency, in other words the average electrical power supplied tot the LED. For example, at a certain current level and pulse width and-frequency, a LED has a certain output. If the junction temperature changes, the output also changes, according to a known function. By measuring the temperature change according to the invention, a new input power level can be set in order to obtain the required LED output level. This embodiment, with an adjustable pulsed electrical power source, has an advantage in that other LED characteristics that may be dependent on the absolute level of the current do not change.

In cases where continuous operation of the LED is necessary, it is still possible to apply the control method and system according to the invention. Thereto, it is for example possible to measure the resistance of the LED while in the operative condition. This may be brought about by determining the current through the LED with knowledge of the voltage across the LED. In other words, in practice this comes down to measuring the voltage drop across the LED when the known current I(LED) is supplied to the LED. Note that in most cases this requires a much more precise determination of the resistance, i.e. of the voltage, since in a practical operative condition, the LED has a much smaller resistance than in a condition as described above.

FIG. 4 schematically shows I,V characteristics of an example of a LED at certain junction temperatures. An actual junction temperature may be based on these curves, for example by interpolating a measured current at a predetermined voltage, or vice versa. A lighting device, and a lighting system including such a lighting device and an adjustable power source, includes at least one LED, a control device employing a device for measuring a quantity that is indicative of an electrical resistance of the LED at a predetermined current or voltage, a power supply control device for controlling an adjustable electrical power supply for driving the LED. The electrical resistance of a LED is functionally dependent of the LED's junction temperature, which in turn determines its optical output characteristics. Thus, by measuring the junction temperature indirectly, through measuring of electrical LED characteristics, and mapping them to a temperature, LED output control is possible.

The invention claimed is:

1. A lighting device, comprising at least one light emitting diode (LED); and a control device, comprising:

a measuring means for determining a value of a quantity correlated to operation of said LED, and a power supply control means operatively connected to said measuring means for providing a control signal to an adjustable electrical power supply for driving the LED, said signal being based on said value of said quantity determined by said measuring means, wherein said quantity is indicative of an electrical resistance of said LED.

2. The lighting device of claim 1, wherein said quantity comprises an electrical current through said LED at a predetermined measuring voltage across said LED, and/or a voltage across said LED at a predetermined measuring current through said LED.

3. The lighting device according to claim 2, wherein said measuring means comprises a measurement voltage source for providing said predetermined measurement voltage, and/or a measurement current source for providing said predetermined measuring current.

4. The lighting device according to claim 2, wherein said predetermined measurement voltage is smaller than a forward driving voltage of said LED, or said predetermined measurement current is smaller than a forward driving current of said LED.

5. The lighting device according to claim 1, wherein the control device comprises a switch selectably connecting said LED to said measuring means.

6. The lighting device according to claim 1, wherein the control device comprises an information retrieval means, that contains information on the control signal as a function of the measured value of said quantity.

7. The lighting device of claim 6, wherein the information retrieval means comprises a look-up table.

8. The lighting device of claim 1, comprising at least two LEDs, wherein said value of said quantity is selectably measurable by said control device for each of the at least two LEDs.

9. The lighting device of claim 8, wherein each of the at least two LEDs is individually drivable by an adjustable electrical power supply based on said measured value of said quantity for said LED.

10. A lighting system, comprising a lighting device according to claim 1, and an adjustable electrical power supply connected to a LED of said lighting device, for supplying electrical energy to drive said LED.

11. The lighting system of claim 10, wherein the adjustable electrical power supply is further able to provide a predetermined measuring voltage across said LED, and/or a predetermined measuring current through said LED, wherein said predetermined measurement voltage is smaller than a forward driving voltage of said LED, or said predetermined measurement current is smaller than a forward driving current of said LED.

12. A method of driving a lighting system according to claim 10, the method comprising:

setting said adjustable electrical power supply to a desired operating condition for at least said LED;

measuring a value of a quantity that is indicative of an electrical resistance of said LED;

determining a new operating condition of said LED, based on said measured value; and adjusting said adjustable electrical power supply to said new operating condition.

13. The method of claim 12, wherein measuring said value comprises measuring of an electrical current through said LED predetermined measuring voltage across said LED, and/or measuring of a voltage across said LED at a predetermined measuring current through said LED.

14. The method of claim or 13, wherein said predetermined measuring voltage is smaller than a voltage across said LED in an operating condition of said LED, and/or said predetermined measuring current is smaller than a current through said LED in an operating condition of said LED.

15. The lighting device of claim 3, wherein said predetermined measurement voltage is smaller than a forward driving voltage of said LED, or said predetermined measurement current is smaller than a forward driving current of said LED.

16. The lighting device of claim 15, wherein the control device comprises a switch for selectably connecting said LED to said measuring means.

17. The lighting device of claim 2, wherein the control device comprises a switch for selectably connecting said LED to said measuring means.

18. The lighting device of claim 3, wherein the control device comprises a switch for selectably connecting said LED to said measuring means.

19. The lighting device of claim 4, wherein the control device comprises a switch for selectably connecting said LED to said measuring means.

20. The lighting device according to claim 2, wherein the control device comprises an information retrieval means that contains information on the control signal as a function of the measured value of said quantity.

* * * * *